United States Patent [19]

Kruppert

[11] Patent Number: 4,504,042

[45] Date of Patent: Mar. 12, 1985

[54] APPARATUS FOR HEAT TREATING STEEL

[75] Inventor: Frederick W. Kruppert, Goulais River, Canada

[73] Assignee: Kruppert Enterprises, Inc., Goulais River, Canada

[21] Appl. No.: 519,705

[22] Filed: Aug. 2, 1983

Related U.S. Application Data

[62] Division of Ser. No. 348,694, Feb. 16, 1982, abandoned.

[51] Int. Cl.[3] ..... C21D 9/08; C21D 1/62

[52] U.S. Cl. ..... 266/115; 266/134; 266/121

[58] Field of Search ..... 266/114, 115, 117, 121, 266/130, 134, 111–113; 148/153, 155, 156, 157

[56] References Cited

U.S. PATENT DOCUMENTS

| | | | |
|---|---|---|---|
| 2,307,694 | 1/1943 | Malke | 34/15 |
| 3,212,766 | 10/1965 | Heinenberg et al. | 148/157 |
| 3,294,599 | 12/1966 | Huseby | 148/143 |
| 3,623,716 | 11/1971 | Fritsch et al. | 266/6 |
| 3,682,722 | 8/1972 | Winstrom | 148/143 |
| 3,807,714 | 4/1975 | Hollyer | 266/134 |
| 3,877,685 | 4/1975 | Franceschina et al. | 266/4 |
| 3,915,763 | 10/1975 | Jennings et al. | 148/127 |
| 3,997,376 | 12/1976 | Hemsath et al. | 148/143 |
| 4,046,603 | 9/1977 | Landgraf | 148/144 |
| 4,110,092 | 8/1978 | Kunioka et al. | 62/64 |
| 4,165,246 | 8/1979 | Reinke et al. | 148/150 |
| 4,204,892 | 5/1980 | Economopoulos | 148/145 |

FOREIGN PATENT DOCUMENTS

| | | | |
|---|---|---|---|
| 125917 | 11/1978 | Japan | 148/143 |
| 603681 | 3/1978 | U.S.S.R. | 266/114 |

OTHER PUBLICATIONS

M. A. Grossmann, et al., "Quenching, Internal Hardness Distribution and Depth of Hardening", pp. 43–52, (1964).

ASM Committees on Quenching and Martempering, "Quenching and Martempering", pp. 5–216, (1964).

*Primary Examiner*—L. Dewayne Rutledge
*Assistant Examiner*—Christopher W. Brody
*Attorney, Agent, or Firm*—Arnold, White & Durkee

[57] ABSTRACT

A process is provided for heat treating steel in which each segment of a piece of steel is quenched in a quenching zone by directing the flow of a sufficient amount of a cooling medium against a surface of each segment to lower the temperature of the segment to a desired temperature while vaporizing substantially all of the cooling medium to create a vapor blanket around at least one surface of each segment so cooled. In one embodiment, steel pipe is heated above its critical transformation temperature and then each longitudinal segment of the pipe is sequentially quenched by substantially simultaneously sending a sufficient amount of water against the inside and outside surfaces of each segment to reduce the temperature of the segment to within a predetermined range while vaporizing substantially all of the water to create a steam blanket around the segment. The steam blanket is then maintained on at least the inside surface of each segment in order to control the temperature change of each segment until the pipe is subjected to further processing. An apparatus for heat treating a steel pipe is also provided including a preheater for heating the steel pipe; feeding means adapted to feed the steel pipe at a variable rate from the preheater; a flow chamber into which the steel pipe is fed, the flow chamber being adapted to bring a cooling medium into contact with the outer surface of a segment of the steel pipe; and an internal feeder having an outside diameter less than that of the steel pipe and adapted to direct a cooling medium against a contoured surface of a plug. The plug is of sufficient size to seal slidably the inside cross section of the steel pipe as it passes into the flow chamber.

10 Claims, 6 Drawing Figures

APPARATUS FOR HEAT TREATING STEEL

This is a divisional application of application Ser. No. 348,694, filed Feb. 16, 1982 now abandoned.

BACKGROUND OF THE INVENTION

The present invention relates to a method and apparatus for hardening steel and more particularly to a method and apparatus for hardening steel pipes of substantial thickness and length.

Steel is essentially an alloy of iron and carbon. Additionally, it may contain small amounts of manganese, phosphorus, or silicon, which may be added to enhance such properties as hardness, strength, ductility, and toughness.

While a trace amount of carbon is dissolved in the iron to form a constituent known as ferrite, most of the carbon in steel exists as an intermetallic compound known as iron carbide or cementite, which forms a configuration with the ferrite known as pearlite. When a pearlite carbon steel is heated to a sufficiently high temperature, carbon steel is heated to a sufficiently high temperature, a face-centered cubic lattice crystal structure, known as austenite, begins to form, dissolving substantial amounts of carbon in the steel. The transformation temperature for most steels is generally in the range of 1340° F. (725° C.) to 1450° F. (790° C.).

When austenite steel is subsequently cooled below its critical transformation temperature, it decomposes into other forms such as pearlite, bainite, martensite, or combinations thereof. These constituents determine the array of properties possessed by the steel. The formation of these constituents is a function of both the type of steel and the rate of cooling from the critical transformation temperature. Thus, the form into which the austenite decomposes, and hence the exact nature of the resulting steel, depends not only upon the initial composition of the steel, but also the sequence of cooling. At one extreme, very rapid cooling or quenching to about 450° F. (232° C.) and then to about 250° F. (121° C.) produces a very hard constituent, known as martensite. At the other extreme, slow cooling, as in ambient air, produces a coarse pearlite. Between these two extremes in cooling a wide variety of constituents may result. However, the minimum rate of cooling is often severely limited if the formation of pearlite is to be avoided.

Over the years there have developed a variety of methods to facilitate the production of large segments of steel. These methods involve the use of alloys, which alter the point at which a given constituent will form; variations in the amount of carbon, which affect the formation of martensite and therefore hardness; and specific cooling sequences and methods.

It has long been a common practice to harden steel by heat treating followed by quenching. Typically, the steel is heated above the critical transformation temperature at which it becomes austenitic and is then cooled fast enough, usually by quenching into a liquid such as water or oil, to avoid any transformation of the austenite until the steel reaches the relatively low temperature range within which it transforms to a hard, martensitic microstructure. The steel is subsequently reheated or tempered to remove the internal stresses caused by the inherent expansion of the martensite.

Martempering and austempering, which may be thought of as modifications to the traditional heat treating and quenching process, represent two widely used commercial processes.

Both martempering and austempering produce high strength steels. In martempering, rapid cooling from the critical transformation temperature is interrupted just above the martensitic transformation temperature, e.g., about 450° F. (232° C.), which varies according to the steel's composition. The surface of the steel is then held at a constant temperature until this temperature is equalized throughout the piece. Then it is cooled to room temperature in order to minimize cracking caused by severe differential cooling stresses set up in the brittle martensite. The steel is subsequently tempered as in regular heat treating and quenching. No bainite is allowed to form.

In austempering, the steel is quenched to a fixed temperature and held at that tempwerature, e.g. 500° to 750° F. (260° 1 to 399° C.) depending on the steel, until the austenite completely transforms to bainite and the hardening transformation is complete. This process involves less total time since no additional tempering is needed. The resulting bainite structure has a higher level of toughness for a given hardness.

The general superiority in mechanical properties of austempered steel over martempered steel is shown in the Table 1 for a 0.74% carbon steel for two given temperature sequences. The data is taken from Grossmann and Bain, *Principles of Heat Treatment* (5th Edition 1972), p. 179.

TABLE 1

| Mechanical Properties | Austempered Steel | Martempered Steel |
|---|---|---|
| Rockwell C hardness | 50.4 | 50.2 |
| Ultimate strength, psi | 282,700 | 246,700 |
| Yield point, psi | 151,300 | 121,700 |
| Elongation, % in 6 inches | 1.9 | 0.3 |
| Reduction of area, % | 34.5 | 0.7 |
| Impact, ft-lb | 35.3 | 2.9 |

Ausforming represents a modification of martempering. In ausforming the cooling sequence is interrupted in the 600°-800° F. (315°-427° C.) temperature range and subjected to plastic deformation prior to transformation to martensite and subsequent tempering. Although only certain alloy steels are capable of undergoing ausforming, the combination of strain-hardening and quench-hardening, followed by tempering, produce a very strong product.

All of these processes suffer from a number of limitations. For example, even though carbon is inexpensive and constitutes the most important source of hardness, the carbon content of a martensitic steel is limited. As the amount of carbon increases for a given steel, the martensitic transformation temperature lowers and the martensite formed becomes harder. Since steel is less plastic at lower temperatures and so less able to accommodate the internal stresses caused by the volume changes accompanying the formation of martensite, the addition of carbon enhances the chance of cracking. Consequently, the amount of carbon and hence the maximum hardness obtainable in a martensitic steel is limited.

Additionally, exact temperature control over time is often required if specific results are to be obtained. For example, quenching, martempering, and austempering all require very rapid cooling, particularly in the temperature range around 1050° to 950° F. (570° to 510° C.)

within which relatively soft pearlite would form with very little delay.

Given the importance of the cooling rate in producing the desired properties and regulating internal stresses in a given steel, the production of large pieces of steel has always presented particular difficulties, since the temperature drop at the center lags the temperature drop at the surface. The quenching of steel from its critical transformation temperature to the martensitic transformation temperature requires a rather severe cooling rate if the formation of pearlite is to be avoided. If the steel is to be austempered after initial quenching, it must be maintained within a relatively narrow temperature range above the initial martensitic transformation temperature. However, if the piece is cooled sufficiently to avoid formation of pearlite, it is often not possible to prevent significant portions of the steel from falling below the martensitic transformation temperature. Similarly, if the steel is to be subject to martempering or modified martempering, the cooling rate must be significantly slower near or through the martensitic transformation temperature range due to the high expansion and resultant internal stresses caused by the formation of martensite. Yet, regulation of the cooling rate or maintenance of a constant temperature is often difficult.

A number of processes have been developed in an attempt to address these problems. Metal alloys, such as manganese, silicon, nickel, or chromium have been added to retard the formation of pearlite to allow for a slower initial quench and to otherwise enhance the final properties of the steel. Although metal alloys and increased amounts of carbon have been used to make steel amenable to austempering in larger sections, alloys add considerably to the expense of the steel.

Additionally, the toughness and strength produced with alloys in steels having a carbon content of roughly 0.65% or less is often very close for austempering and martempering. Accordingly, austempering has not been much utilized in larger sections with alloy constructional steels having a low carbon content since martempering procudes similar toughness and strength.

Although high strength and high toughness can be achieved by austempering high carbon alloy steels, excessively long time intervals are required for complete transformation to the bainite structure. In austempering the steel must be quickly reduced to a given temperature throughout and then held at that temperature until the austenite completely transforms to bainite. Given the lag in the change between surface and internal temperatures and the need for subsequently maintaining a constant temperature as bainite transformation occurs, the size of a piece of carbon steel which may be austempered is severely limited. Rods or other shapes having an effective diameter of much more than 0.25 inches (0.64 cm) have probably not generally been effectively austempered. Similarly, austempering has not heretofore proven effective for pipes having a wall thickness of approximately 0.125 inches (0.32 cm) or greater.

A variety of quenching materials and related processes have developed in an attempt to control temperature transformations in hardening steel. As to the quenching medium, a water quench is generally preferable due to availability, reduced health hazards, effectiveness in removing scale from the surface of steel parts, and high heat capacity. However, the high rate of cooling creates and causes problems in controlling temperature, especially where larger pieces of steel are being treated. This is particularly the case where a water bath is employed.

In salt quenching, the steel is generally quenched in a salt bath at 800° F. (427° C.) and then cooled in air. However, salt is more expensive than water as a cooling medium and air cooling is nonuniform, thus causing hot spots leading to weak points in the steel. Additionally, the molten salt generally provides a comparatively poor quench. Although the molten salt successfully avoids any temperature drop below the temperature of the salt bath, the attainable rate of cooling is not particularly fast, especially when compared with water.

Oil quenches have been used to reduce the rate of cooling of hot steel. However, the reduced rate of cooling can result in the formation of pearlite. Additionally, oil quenching is expensive, relatively slow, and creates pollution problems.

A variety of methods and devices have been developed in an attempt to properly control heat transfer from both the exterior and interior surface of pipes while using water, as well as other substances, as a cooling medium.

A variety of methods and devices use spray nozzles to impact droplets of water against a pipe. For example, U.S. Pat. No. 3,294,599 discloses an internal quench head which works in conjunction with an external quench head to spray water against the inside and outside surfaces of the pipe, while U.S. Pat. No. 3,682,722 discloses an oil quench from rotating nozzles, which direct a stream of spray against a tubular article.

U.S. Pat. No. 4,165,246 discloses a process for heat treating steel pipes with a wall thickness ranging from 16 to 36 mm. A steel pipe is first heated over a cross section of the pipe wall to the critical transformation temperature. The pipe is then passed on rollers to a cooling zone where water from nozzles encircles the surface of the pipe to quench the surface below the martensitic transformation temperature. As the martensite is formed, heat supplied from the internal unquenched portions of the pipe or an independent source, tempers the martensite surface layer, while the unquenched internal layers form an interstage structure. The speed of the pipe through the process is greater than the critical cooling speed.

U.S. Pat. No. 4,204,892 discloses another method for heat treating steel tubes which also involves the cooling of a surface layer to form martensite followed by self-tempering due to internal cooling. In one embodiment the self-tempering step is followed by a second quench such that the properties of the center of the steel depend on the equalization temperature of the second cooling step. The second cooling step is timed such that the equalization temperature is obtained before transformation of the residual austenite into bainite.

Other processes immerse the surface in the cooling medium. For example in U.S. Pat. No. 3,623,716 there is disclosed an apparatus for hardening long pipes by passing a cooling medium, such as water, from a nozzle in a helical pattern through the inside of a hot pipe which is immersed in a bath of cooling liquid.

Another steel hardening apparatus, disclosed in U.S. Pat. No. 3,877,685, attempts to control the relative rates of cooling in the interior and exterior surfaces of a pipe. Two streams of water are respectively directed to the inside and outside surfaces of the pipe. The inside surface of the pipe is more effectively cooled due to the speed and helical nature of flow inside the pipe. After the initial quenching stage as the steel enters the martensitic transformation range, the rate of cooling is reduced by the diversion of increasing amounts of water from the inside to the outside of the pipe. A sleeve mechanism, which is located in concentric feed conduits, is used to reduce the flow to the inside portion of the pipe.

U.S. Pat. No. 2,307,694 discloses a cylindrical quenching device which directs water against the cylindrical surface of a hollow barrel as a pipe passes through the barrel.

Other patents disclose devices with a variety of quenching mechanisms using quenching baths and the like.

These and other devices and methods suffer from one or more of several limitations in addition to those already discussed. For example, none of the prior devices are suitable for quenching, martempering, austempering, and ausforming without substantial modification. Additionally, prior devices fail to make efficient use of the inherent heat of the pipe produced by the initial raising of the pipe temperature above the critical transformation temperature. Prior devices and methods using water as a quenching medium also fail to produce a steel pipe of substantial size having a carbon content of greater than 0.50%. Additionally, many prior devices fail to provide efficient heat transfer from the steel pipe. Furthermore, the thickness of a steel pipe which may be successfully austempered or martempered is generally believed to be limited to approximately one inch (2.54 cm) more or less.

These and other limitations of prior processes and methods are substantially minimized, if not eliminated, by the present invention.

SUMMARY OF THE INVENTION

According to the present invention, there is provided a process for heat treating a piece of steel in which the piece of steel is heated and then each segment of the steel is quenched in a quenching zone by directing a sufficient amount of a cooling medium against a surface of each segment to lower the temperature of the segment to a desired temperature while vaporizing substantially all of the cooling medium to create a vapor blanket around at least one surface of each segment so cooled. In one embodiment of this process, a steel pipe is heated above its critical transformation temperature and then each longitudinal segment of the pipe is sequentially quenched by substantially simultaneously sending a sufficient amount of water against the inside and outside surfaces of each segment to reduce the temperature of the segment to within a predetermined range while vaporizing substantially all of the water to create a steam blanket around the segment. The steam blanket or envelope is then maintained on at least the inside surface of each segment in order to control the temperature change of each segment until the pipe is subjected to further processing. According to the invention the rate of passage of each segment through the quenching zone and the amount of water directed against the pipe may be varied in relation to each other.

Also in accordance with the invention, there is provided an apparatus for heat treating a steel pipe including a preheater for heating the pipe; feeding means adapted to feed the steel pipe at a variable rate from the preheater into a flow chamber adapted to selectively bring a cooling medium into contact with the outer surface of a segment of the steel pipe; and an internal feeder having an outside diameter less than that of the steel pipe and adapted to direct a cooling medium against a contoured surface of a plug. The plug is of sufficient size to slidably seal the inside cross section of the steel pipe as it passes into the flow chamber.

In another embodiment the apparatus includes a flow chamber with a hollow cylinder having an inside diameter larger than the outside diameter of the pipe. The cylinder has an inlet and an outlet for the pipe and a series of vanes on the inside walls of the cylinder are adapted to throw a cooling medium toward the center of the hollow cylinder. A cooling medium inlet, adapted to bring the cooling medium in contact with the vanes, and a cooling medium outlet are also provided.

In another embodiment the apparatus includes a preheater; a flow chamber; a feeder adapted to feed the steel pipe at a variable rate from the preheater and through a pipe inlet and outlet of the flow chamber; and a plug of sufficient size to slidably seal the inside cross section of the steel pipe as it passes into the flow chamber. The plug has a tapered front portion adapted to receive the steel pipe as it passes from the preheater to the flow chamber pipe inlet and a contoured end portion opposite the tapered end portion. An internal feeder having an outside diameter less than that of the steel pipe is located so as to direct a cooling medium against the contoured end portion of the plug to thereby selectively bring the cooling medium into contact with the inside surface of a segment of the steel pipe.

By using the apparatus and process of the present invention, steel pipe with increased carbon content, reduced alloy content, increased thickness, improved properties, or some combination thereof may be produced with savings in energy and reductions in water consumption. The apparatus and process may be used in a variety of heat treatments including conventional heat treating/quenching, martempering, austempering, and ausforming.

Examples of the more important features of this invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto.

Reference to these drawings will further explain the invention when taken in conjunction with the description of a preferred embodiment.

DESCRIPTION OF PREFERRED EMBODIMENTS

Figure 1:
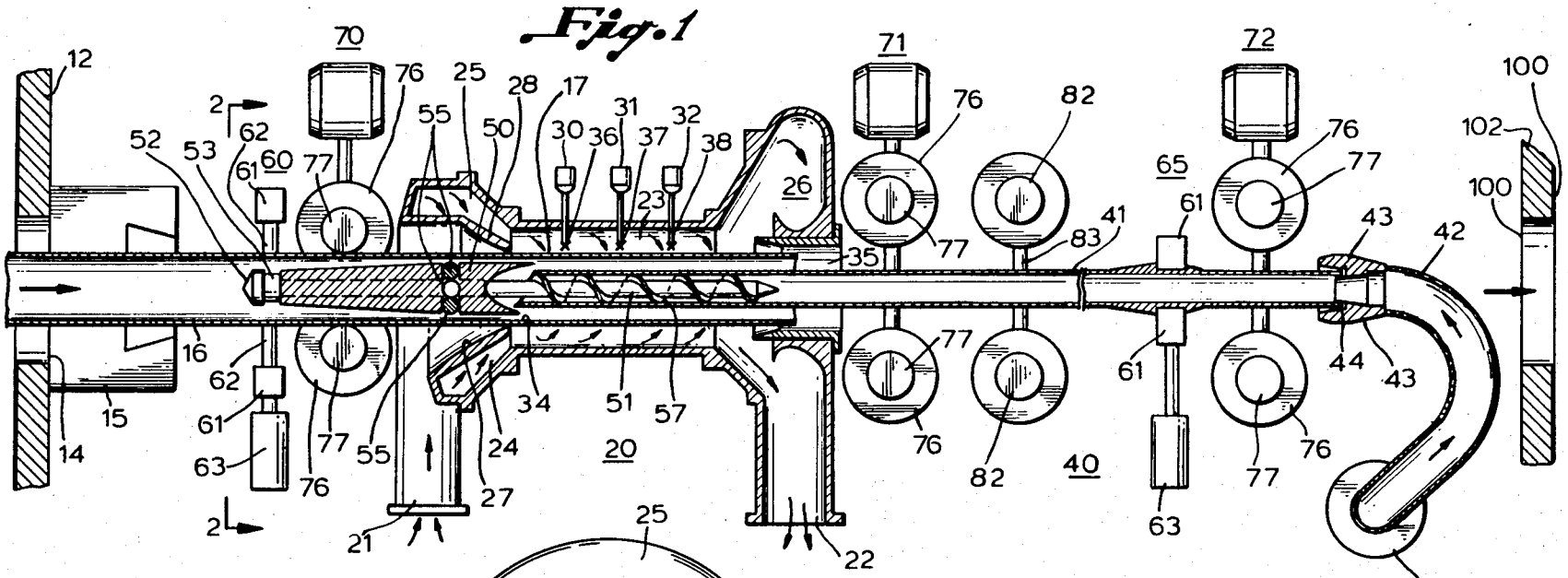
FIG. 1 is an elevation view, partially in schematic form, of a preferred embodiment of the present invention.
Figure 2:
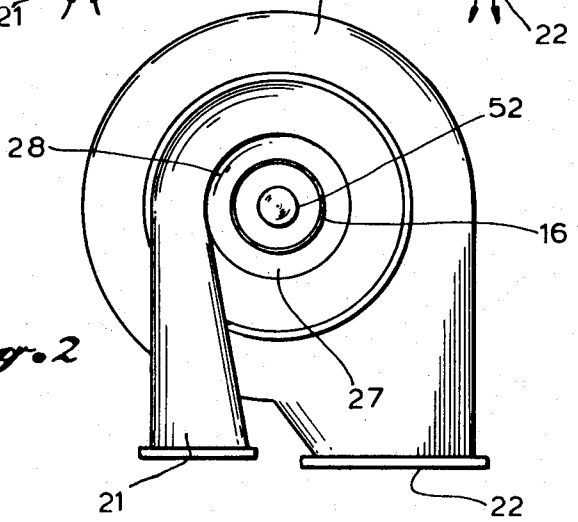
FIG. 2 is a front view taken from line 2—2 in FIG. 1.
Figure 3:
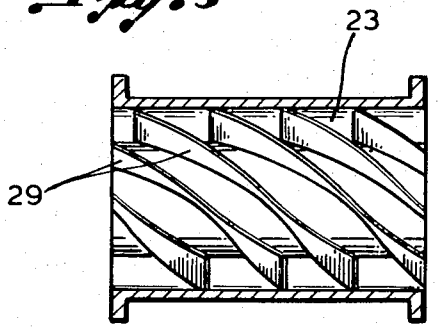
FIG. 3 is a close -up view of a portion of the embodiment shown in FIG. 1.

Referring now to FIGS. 1–3, there will now be described a process and apparatus for heat treating steel pipe in accordance with the present invention. Generally, the apparatus includes an initial heating means 10;

a flow chamber 20; an internal feeder 40; a plug means 50; intermittent support means, indicated at 60 and 65; pipe feed control means, indicated by drive units 70, 71, and 72; optional plasticizing means 80 and treatment chamber 100.

Initial heating means 10 may comprise a furnace 11 for heating steel pipe 16 above its critical transformation temperature. The furnace 11 is equipped with drive rolls (not shown) to push the preheated pipe 16 out of the door or opening 14 in the furnace wall 12 and into engagement with the plug means 50 and flow chamber 20 as shall hereinafter be more fully described. The austenizing furnace 11 is equipped with an insulated extension 15 which is attached to furnace wall 12. Insulated extension 15 helps to maintain the temperature of the pipe 16 above the critical transformation temperature between furnace 11 and flow chamber 20.

The flow chamber 20, along with drive unit 70 and clamp or support means 60, is located a sufficient distance downstream of furnace 12 to avoid any damage to those units. Flow chamber 20 is adapted to bring a cooling medium, such as water, into contact with the outside surface 17 of the pipe 16. The flow chamber 20 comprises a hollow cylinder 23, the inside diameter of which is larger than the outside diameter of the largest pipe 16 to be treated. As shown in FIG. 3, flow chamber cylinder 23 is equipped with adjustable vanes 29 which are adapted to direct the cooling medium away from the surface of flow chamber cylinder 23 and towards the outer pipe wall 17.

Flow chamber cylinder 23 is connected to cooling medium inlet 21 by means of upper guide conduit 25 and lower guide conduit 24. As can be seen in FIG. 1, the outer surface of the interior walls of conduits 24 and 25 are tapered to guide the pipe 16 into flow chamber cylinder 23. The closest distance between tapered walls 27 and 28 is such that the inlet opening 34 to the flow chamber cylinder 23 is just slightly more than the outside diameter of the pipe 16. Thus, as the pipe 16 passes through the inlet 34 it is closely surrounded by the end portions of external walls 27 and 28.

Guide conduits 24 and 25 are adapted to impart a helical motion to the cooling medium passing from inlet 21 into the flow chamber cylinder 23. The adjustable vanes 29 then direct the swirling water with sufficient pressure against the outer pipe wall 17, as shall hereinafter be more fully described.

The flow chamber outlet 35 is of slightly larger diameter than the inlet 34 such that the outer pipe wall 17 and the outlet 35 form an annulus.

The flow chamber 20 is also equipped with optical sensors 30, 31, and 32, or other appropriate sensing devices. which measure the progress of the pipe 16 through the flow chamber cylinder 23, and an upper chamber 26 which is adapted to receive the vaporized cooling medium and so facilitate its passage through the flow chamber body 23 and flow chamber outlet 22.

Flow chamber 20 is also equipped with thermocouples or other appropriate temperature sensing mechanisms, for example as shown at 33, 36, 37, and 38.

The forward segment of the flow chamber 20 comprising the inlet 21 and the guide conduits 24 and 25 may be detachably mounted to the flow chamber cylinder 23 in order to facilitate adjustment for differing sizes of pipe. Alternatively, the tapered walls 27 and 28 may be movably mounted or provided with appropriate extensions to facilitate sealing engagement with varying sizes of pipe.

The size of the various components of flow chamber 20 is such that a cooling medium may be supplied to inlet 21 in sufficient quantity to direct a uniform continuous stream of the cooling medium to the appropriate portion of the horizontally disposed pipe 16. The cooling medium is at a pressure sufficient to cause complete contact with the appropriate surface portion or segment passing through the flow chamber at any given time.

An internal feeder or feed mechanism indicated generally at 40 comprises a floating lance 41 which is connected at one end to a swing-away feed pipe or detachable conduit 42 and at the other end to shaft 51 and spiral vanes 57 of plug mechanism 50. The floating lance 41, which comprises a hollow cylinder or conduit with an external diameter less than that of the pipe 16, is detachably connected to swing-away conduit 42 by means of connectors 43. Packing 44 insures an adequate seal at the juncture of feed pipe and floating lance 41.

Detachable conduit 42 is rotatably mounted in pipe connector 45 and is equipped with an appropriate mechanism, such as an hydraulic cylinder and piston arm (not shown) to move the conduit 42 in and out of engagement with the floating lance 41 and out of the path of pipe 16 as it enters chamber 100.

The plug mechanism 50 is equipped at one end with a header 52. The header 52 is tapered such that it slopes away from the direction of the advancing pipe 16. The header 52 and the end of tapered body portion 54 are spaced to create a notch or clamp groove 53 adapted to receive clamping members 61 of clamp 60. Header 52 and tapered body portion 54 of the plug mechanism 50 serve to guide the pipe 16 as it passes from austenizing furnace 11 into inlet 34 of flow chamber 20.

Plug mechanism 50 is equipped with wheels 55 located at the opposite end of tapered body portion 54 from header 52. The wheels 52 facilitate the movement of pipe 16 past plug mechanism 50 while serving to insure an adequate seal between the plug 50 and inner pipe wall 18.

Shaft 51 is inserted a sufficient distance into floating lance 41 to insure adequate support for spiral vanes 57 as well as the end of floating lance 41 itself. As the spiral vanes 57 are integrally mounted to the inside wall of floating lance 41, the curved or arcuate surface 56 of plug 50 remains a fixed distance from the outlet of floating lance 41. Additionally, spiral vanes 57 and shaft 51 cooperate to support the end of floating lance 41. Thus, the floating lance 41 is always supported by plug mechanism 50 regardless of whether plug mechanism 50 is held in place by clamp 60 or by the pipe 16 and floating lance 41.

The shaft 51 and spiral vanes 57 are of sufficient dimensions to impart a helical or swirling motion to the cooling medium flowing from conduit 42 through lance 41 and into flow chamber 20. The curved surface 56 of plug mechanism 50 serve to reverse this helical flow and throw the water or other cooling medium with sufficient force to insure complete contact of the cooling medium with the inner pipe wall 18.

As austenizing furnace 11 is operated at high temperatures such as 1500° F. (816° C.), the interior of the furnace 11 is at a slightly positive pressure. Thus, the seal created between the inner pipe wall 18 and plug mechanism 50 should be such as to prevent the furnace pressure from causing any material disturbance of the helical flow patterns created by spiral vanes 57 and reversed and directed by arcuate surfaces 56.

The pipe 16 is supported and moved during its passage from austenizing furnace 11 through flow chamber 20 and into unit 100 by drive units 70, 71 and 72. Each of these units comprises a pair of grooved circular rolls 76 having an axial portion 77. Thus, as the pipe passes between the two grooved circular rolls, its upper portion is encompassed by the groove of the upper rolls while the lower portion of the pipe rests in the groove of the lower rolls. As shown in FIG. 1, drive roll 70 is closed around an engaging pipe 16, while drive rolls 71 and 72 are disengaged.

Intermittent support means 60 and 65 support plug mechanism 50 and floating lance 41, respectively. Each intermittent support means or clamp comprises jaws 61 attached to arms 62. The arms 62 are operatively connected to a hydraulic cylinder and control mechanism 63 such that arms 62 bring members 61 in and out of engagement with floating lance 41 or notch or clamp groove 53 of plug mechanism 50. As shown in FIG. 1, clamp 60 is in the open position, i.e., disengaged, while clamp 65 is supporting one end of floating lance 41.

Wall 102 of unit 100 is provided with an opening 101 adapted to receive the pipe 16 as it passes beyond drive unit 72.

Optional platicizing means 80 may be provided downstream of flow chamber 20. For example, the plasticizing means may comprise a pair of drive rolls capable of exerting sufficient pressure to deform the surface of the pipe wall sufficiently for ausforming. As with drive units 70, 71 and 72, plasticizing unit 80 may comprise a pair of two grooved circular rolls 82 mounted on a shaft 83.

In operation a pipe 16 to be heat treated is heated above its critical transformation temperature in furnace 11. At this time clamping members 61 of clamp 60 are engaged with notch or clamp groove 53 in order to provide support for plug mechanism 50. Drive rolls 70, 71 and 72 are disengaged, while clamp 65 supports floating lance 41 in much the same fashion that clamp 60 supports the end of plug 50.

Just as the pipe 16 is to be rolled out from austenizing furnace 11, hydraulic cylinder control mechanism 63 is activated and arms 62 swing outwardly thus disengaging clamping members 61 from notch or clamp groove 53 of plug mechanism 50. Additionally, drive motor and control mechanism 75 of drive unit 70 is activated to bring grooved circular rolls 76 into engagement with pipe 16 as it is run out of furnace 11, over lance header 52 and tapered body portion 54 of plug mechanism 50, and into inlet 34 of flow chamber 20. Wheels 55 of plug 50 facilitate the movement of pipe 16 as plug 50 comes into sealing engagement with inner pipe wall 18.

As the pipe continues on its path into flow chamber cylinder 23 optical sensor 30, through an appropriate control mechanism (not shown), triggers the flow of water into inlet 21 of flow chamber 20 and into conduit 42 and floating lance 41. In accordance with the present invention, the amount of water channeled into floating lance 41 as well as the pressure and rate of flow are controlled along with the speed of the pipe 16 so that substantially all of the water entering the annulus formed by the outer wall of floating lance 41 and inner pipe wall 18 is vaporized as it comes into contact with the inner pipe wall 18. Similarly, the flow of water passing through inlet 21 and upper and lower guide conduits 24 and 25 is such that substantially all of the water is vaporized as it comes into contact with outer pipe wall 17. Thus, as each segment of inner pipe wall 18 and outer pipe wall 17 enters into flow chamber 20 it is quenched in a quenching zone by the water stream thrown against it and then blanketed or enveloped by the resulting steam.

Thermocouples 33, 36, 37, and 38 along with optical sensors 30, 31, and 32 monitor the pipe speed and the temperature near the pipe surface. As understood by those skilled in the art the location and number of the various optical and thermal sensors may be varied as appropriate.

The information from the sensors is fed into a controlling mechanism (not shown) used to regulate both the speed of the pipe as it passes from furnace 11 to unit 100 as well as the pressure and flow of water into floating lance 41 and flow chamber 20 such that the inherent heat of each segment of pipe is sufficient to vaporize substantially all of the water flowing against outer pipe wall 17 and the inner pipe wall 18. As substantially all of the water vaporizes, a blanket of steam envelopes the inner and outer pipe wall segment as it passes through the flow chamber 20. Depending upon the preferred cooling rate, it may be preferable in some cases to control the speed of the pipe and flow of water such that the water is not substantially completely vaporized until water is being directed against the next segment of the pipe.

Although the size of the segment which passes prior to vaporization of all of the water may vary depending upon the cooling sequence desired, it is to be understood that the process is an incrementally continuous process such that each segment or increment of pipe may be quite small. Additionally, as the process is a continuous one the distinction between segments will generally be blurred.

As the pipe 16 passes through the outlet 35 of flow chamber 20 the steam created by the inherent heat of the pipe 16 escapes from the annulus created by the outer pipe wall 17 and the outlet 35. Similarly, steam also escapes from the ever lengthening annulus formed by inner pipe wall 18 and the outer surface of floating lance 41. The length of the annulus formed by pipe surface 17 and the walls of cylinder 23 may be partially or fully extended, if desired, by means of a cylindrical covering or plate (not shown) attached to the flow chamber near or congruent with outlet 35. Drive unit 71 may be moved downstream if necessary. With such a full or partial extension of the walls of cylinder 23, the time during which the outer pipe 17 is exposed to ambient air can be greatly reduced.

As the pipe approaches drive unit 71, it is activated and circular rolls 76 of drive unit 71 engage the pipe in the same fashion as those of drive unit 70. As the front end of the pipe continues to move toward chamber 100, the inner pipe wall 18 remains enveloped by steam. Thus, although the outer pipe wall 17 is now exposed to ambient air, the temperature drop at the outer pipe wall surface can be minimized and the temperature of the inner pipe wall 18 can be maintained. If desired, additional heating means (not shown) may be provided to maintain or raise the temperature of the outer pipe wall 17. However, such additional heating means is not generally required.

In accordance with the present invention after the water initially contacts the pipe, water does not impinge upon the pipe 16 but rather wraps pipe 16 in a vapor blanket. The existence of the vapor blanket is in turn controlled by water flow into inlet 21 of flow chamber 20 and lance feed conduit 41 as well as the speed of pipe 16 as it passes from furnace 11 to chamber 100. Thus, generally only three variables, i.e., the two different flow rates and the speed of the pipe, need be controlled.

As the front end of the pipe 16 approaches clamp 65, hydraulic cylinder mechanism 63 moves arms 62 and so brings clamp 61 out of engagement with floating lance 41. Drive unit 72 then engages the pipe as it passes through its drive rolls in much the same fashion as drive unit 71. The flow of water through floating lance 41 is then cut off and detachable conduit 42 is disengaged from floating lance 41 by means of an arm and a hydraulic cylinder or other suitable mechanism (not shown). The front end of the pipe 16 then passes into chamber 100 through opening 101 in wall 102.

As the rear portion of the pipe 16 passes through the various units and stages, the components are brought back to their original positions in preparation for receiving another pipe. For example, as the end of the pipe passes lance head 52 and tapered body portion 54 of plug 50, the hydraulic cylinder control mechanism 63 of clamp 60 operates on arms 62 to bring clamp 61 into engagement with notch or clamp groove 53 of plug 50. The end of plug 50 is thus once again supported by clamp 60.

As the end of pipe 16 passes through drive unit 70 grooved circular rolls 76 are retracted and as the end of the pipe passes through inlet 34 of flow chamber 20, the flow of water into inlet 21 is suspended. Similarly, rolls 76 of drive unit 71 and drive unit 72 open and clamping members 61 of clamp 65 once again engage the outer surface of floating lance 41 in order to support the same, while detachable conduit 42 is placed in communication with floating lance 41.

Although the foregoing description is in terms of a single pipe, one skilled in the art will appreciate that the mechanism and inventive concepts may be readily adapted to the sequential processing of a large number of pipes of varying sizes.

Adjustable vanes 29 in hollow cylinder 23 and spiral vanes 57 in cooperation with arcuate surface 56 of plug 50 serve to throw the water or other cooling medium against the pipe surfaces. This flow pattern in cooperation with the vaporization of the water by the inherent heat of the pipe to be heat treated provide rapid cooling capable of accommodating a very severe quench to a predetermined temperature at which the pipe can then be maintained prior to further processing. Both the rate of speed of the pipe as controlled by variable speed drive motors 75 of drive units 70, 71, and 72 and the flow rate and pressure of the cooling medium entering flow chamber 20 and floating lance 41 combine to control the temperature sequence through which each segment of the pipe passes. Thus, in accordance with the present invention, appropriate process controls may be employed to control the flow rate of the cooling medium and the speed of the pipe as it progresses from furnace 11 to chamber 100 and so closely regulate the cooling sequence of each segment of the steel pipe 16. The details of the various process controls which may be used to regulate the cooling sequences will be apparent to those skilled in the art from the descriptions contained herein.

According to one aspect of the present invention the floating lance 41 of internal feeder 40 is adapted to allow each pipe to pass substantially directly from heating means 10 to chamber 100. There is no need to remove the pipe laterally after it passes over floating lance 41 prior to passing the pipe to chamber 100 for further treatment. Thus, in a preferred embodiment the floating lance 41 is stationary in relation to flow chamber 20 due to the operation of clamp or intermittent support means 60, plug 50, clamp 65, and detachable conduit 42. As swinging conduit 42 is detachable from floating lance 41 and may swing out of the path of the pipe as it passes over the end of floating lance 41 nearest chamber 100, the pipe may pass directly to chamber 100.

Figure 4:
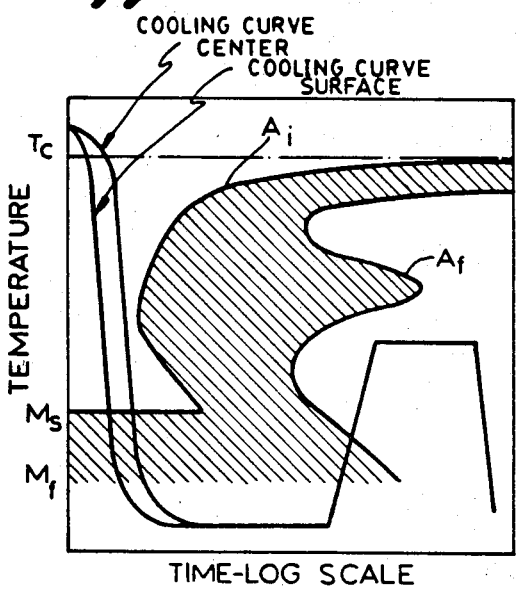
FIGS. 4–6 are isothermal transformation diagrams illustrating conventional quenching, martempering, and austempering, respectively.
Figure 5:
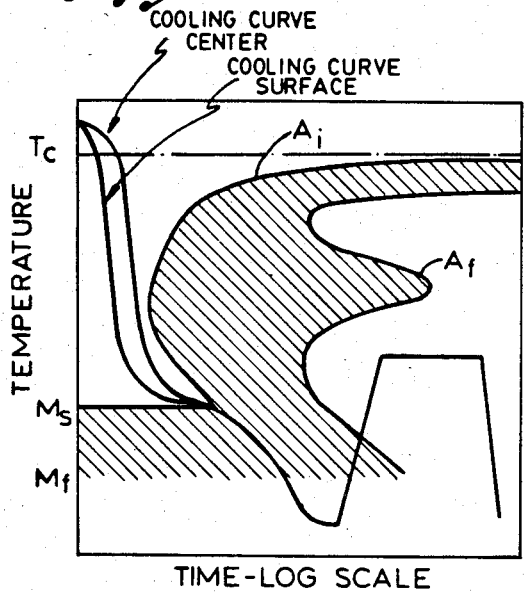
Figure 6:
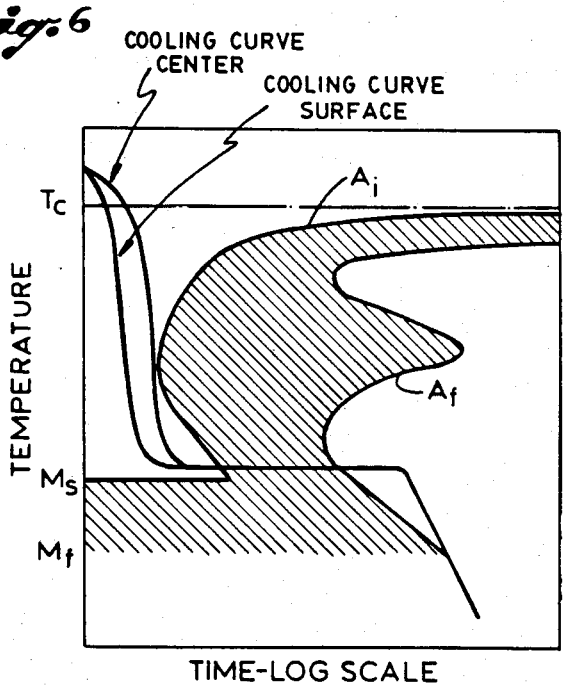

Reference will now be made to FIGS. 4–6 to describe conventional heat treating/quenching, martempering, and austempering as accomplished in accordance with the present invention.

Each isothermal transformation diagram or S-curve represents a graph which charts the transformation of austenite as a function of temperature and time. The diagram permits an approximation of how a given steel will respond to a particular cooling sequence. The crosshatched areas between lines $M_s$–$A_i$ and $M_f$–$A_j$ represent the regions of transformation from austenite to other forms such as pearlite, bainite, and martensite. This area is partially bounded on one side by line $M_s$, which indicates the temperature at which martensite starts to form on quenching from the critical transformation temperature indicated by $T_c$. The area is further bounded by curved line $A_i$, which represents the temperature at which transformation to pearlite or bainite will begin after a given amount of time. Horizontal line $M_f$ and curved line $A_f$ serve to define the other boundary of the transformation area. The horizontal line $M_f$ indicates the temperature at which 100% martensite is formed, while $A_f$ represents a completed transformation to pearlite or bainite, depending upon the location on the curve.

The form of the $A_i$, $A_f$ curves as well as the location of the $M_s$ and $M_f$ lines is a function of a given steel's composition, including carbon and alloy content, and the grain size of the austenite which is undergoing tranformation. In most cases an increase in alloy content generally retards isothermal transformation, i.e., moves the curve toward the right, at any temperature higher than about 900° F. (482° C.), where the initial transformation curve, $A_i$, comes closest to the zero time axis.

As the amount of carbon in a given steel increases, the hardness of the martensite subsequently formed increases while the martensitic transformation temperature ($M_s$) decreases. This in turn enhances the possibility of cracking, particularly where a fast rate of cooling is maintained through the martensite transformation range, i.e., as the temperature decreases from $M_s$ to $M_f$.

Before proceeding to discuss the individual processes, some other points concerning the isothermal transformation curves should be noted. First, time is on a log scale. Thus, the time available in which to avoid the nose or knee of the initial transformation curve ($A_i$) at a point where pearlite begins to form is minimal. In most cases it is on the order of a few seconds.

Second, the various transformation curves are only approximations. For example, the martensitic transformation temperature $M_s$ may vary somewhat for any given point on a piece of steel. Thus, it is often necessary to operate in a region somewhat removed from a given transformation curve in order to avoid formation of a given structure.

Third, the curve marked surface represents the cooling rate curve for the outer surface of a piece of steel pipe whereas the curve marked center represents the cooling rate curve for the center of the pipe wall. As the temperature change in the center will naturally lag the temperature change at the surface, the distance between these two cooling curves will increase with an increase in thickness of the steel for a given method of cooling.

FIG. 4 shows the cooling sequence for customary quenching and tempering. As indicated in FIG. 4 the austenite steel is quickly cooled or quenched from a temperature above the critical transformation temperature $T_c$ to a temperature below the complete martensite transformation temperature $M_f$. As the martensite expands, the resulting martensitic steel is unstable and must be tempered to produce the final product, a tempered martensite.

In prior processes, the thickness of steel pipe which could be quenched was limited to a thickness of approximately 1 inch (2.54 cm), since at any greater thickness the central cooling curve would cross the knee or nose of the initial transformation curve ($A_i$), thus resulting in the formation of undesirable pearlite. Although the addition of alloys moved the nose or knee of the initial transformation curve to the right and hence provided more leeway in cooling the center, the use of alloys substantially increases the cost of the steel.

In accordance with the present invention, the water is vaporized as soon as or soon after it impinges upon the steel. Additionally, a helical flow is created by spiral vanes 57 and curved surfaces 56 on the interior of the pipe and by adjustable vanes 29 on the exterior of the pipe. This combination of helical flow and substantial vaporization produces more efficient transfer of heat than heretofore possible in the heat treatment of steel. Thus, a quench in accordance with the present invention serves to move the surface and center cooling curves to the left and so minimizes or eliminates the need for expensive alloys to move the knee of the initial transformation curve to the right. After initial quenching in the flow chamber 20, the steam blanket maintains the temperature as shown in FIG. 4 until the pipe passes into chamber 100 for tempering.

Referring now to FIG. 5, as already indicated martempering allows the use of a steel with a higher carbon content, since the rate of martensite transformation is accomplished over a longer span of time. However, as a practical matter, prior processes are generally limited to the martempering of steels with a carbon content of approximately 0.50% or less. By way of example a one-sided quench of a steel pipe is limited to a steel with a carbon content of about 0.45%, while a two-sided quench is limited to a steel with a carbon content of approximately 0.33% or less. This is due to the fact that sufficiently exact temperature control is not possible, particularly after the sever quench often necessitated by the need to avoid the nose of the initial transformation curve ($A_i$). For example, if a steel pipe was plunged into a bath of ice water in order to provide a sufficiently severe quench in the center of the pipe wall, the surface would then dip below the martensitic transformation temperature $M_s$, thus setting up immediate transformation of a portion of the steel to martensite accompanied by the concomitant problems of martensitic expansion and cracking.

In accordance with the present invention, a steel pipe having a carbon content of from 1.0 to 1.5% or greater and a thickness of up to 2.5 inches (6.4 cm) and greater can be successfully martempered. This is due to the fact that in accordance with the present invention there is provided a process which allows a sufficiently severe quench to a fixed temperature followed by a controlled and gradual change in temperature such that the increased stresses due to higher carbon content may be accommodated. Thus, a given martempered steel may have a lower alloy content, a greater carbon content, greater thickness or some improved combination of these not previously possible.

In martempering the pipe 16 may be severely quenched by the vaporization of water flowing from floating lance 41 and inlet 21. However, due to the presence of the steam blanket or envelope, the temperature does not fall below a given temperature above the martensitic transformation temperature $M_s$. As the pipe passes from the flow chamber 20, it then begins to cool gradually in the air as it approaches chamber 100, thus providing a controlled cooling rate. Control of the amount of water fed through inlet 21 and floating lance 41 along with the rate of speed of the pipe as it progresses from furnace 11 to chamber 100 provides control of the slope of the cooling curve through the martensite transformation region, i.e., between lines $M_s$ and $M_f$, since this in turn allows control of the temperature and the extent of the internal and external steam blankets. As with customary quenching and tempering, the pipe may be tempered downstream of drive unit 72 and conduit 42 in chamber 100.

Referring now to FIG. 6, as already discussed austempering is a hardening process based upon isothermal transformation of austenite to bainite. As indicated in FIG. 6 the steel must again be severely quenched such that the cooling curve for the center of the pipe wall avoids the knee of the initial transformation curve $A_i$. However, unlike martempering the steel must then be maintained within a narrow temperature range above the martensitic transformation temperature until transformation to bainite is completed.

Prior processes have been unable to successfully austemper steel pipes with a wall thickness of greater than approximately one inch (2.54 cm) more or less, since prior processes were not able to provide a sufficiently severe quench and still avoid the formation of martensite on the surface of the pipe. However, the present invention reduces the temperature lag between the surface and center cooling curves and moves them to the left. The present invention also allows the subsequent maintenance of the steel at a constant temperature until it may be transferred to an oven or furnace to complete the transformation to bainite. Thus, unlike prior art processes steel pipe of fairly large thicknesses can now be successfully austempered.

As each portion of the pipe enters the flow chamber 20 both the exterior and interior surfaces of the pipe are quenched by water coming from floating lance 41 and inlet 21 of flow chamber 20. Thus, each segment is quickly quenched from the critical transformation temperature to the appropriate temperature just above the martensitic transformation temperature. In accordance with the present invention the vapor blankets or envelopes which surround the inside and outside surfaces of the pipe 16 are maintained for an appropriate distance along the pipe once produced by the inherent heat of the pipe 16. The flow of water and speed of the pipe are controlled such that the supply of heat radiated from the pipe 16 equals or exceeds the amount of heat needed to form the appropriate amount of vapor per unit surface area of the steel pipe 16. As the vapor envelope acts as an insulator, such that cooling occurs principally by radiation through the vapor film of the pipe, the temperature remains essentially constant for whatever period of time necessary to facilitate the transformation of austenite to bainite.

As with martempering, a given austempered steel may have a lower alloy content, a greater carbon content, greater thickness, improved properties or some combination of these. By way of example, given an appropriate alloy content, a steel pipe austempered by traditional processes might have a yield strength as high as about 150,000–160,000 psi. Now, yield strengths of 250,000 psi or possibly higher may be obtained by practice of the present invention.

The present invention may also be used to advantage in ausforming a given steel pipe. In ausforming the steel is quenched to temperatures between about 600° and 800° F. (316° to 427° C.) and then isothermally transformed to pearlite. The pearlitic steel is then converted to martensite after being plasticly deformed by mechanical working. Thus, in accordance with the present invention, the flow of water and speed of the pipe are regulated to quench the steel to a desired temperature (for example 600°–800° F.) or 316°–427° C.). The steel is then isothermally deformed by austempering roll 81 and transferred to chamber 100 for appropriate tempering. Again, larger thicknesses of pipe may be ausformed than heretofore possible and under more favorable conditions given the improved temperature control provided by the formation of controlled amounts of steam from the inherent heat of the pipe.

Although in most cases the temperature of the water fed into inlet 21 and floating lance 41 is not believed to be particularly critical in obtaining the benefits of the present invention, it is preferable if the water has a temperature of about 80° F. (27° C.) and preferably 70° F. (21° C.) or less, since the cooling power of water increases rapidly as water temperature decreases beyond about 75° F. (24° C.). In fact, this loss of cooling power is almost expotential such that water at a temperature of 120° F. (49° C.) has only about 20% of the cooling power of water at 70° F. (21° C.). However, use of water at a higher temperature can still prove advantageous when compared to prior processes using water of a similar temperature due to the favorable flow pattern created by the vanes and the vaporization of the water as well as use of the heat of vaporization for cooling.

As the foregoing discussion indicates and unlike the prior art processes, the apparatus of the present invention may be used to accomplish conventional quenching, martempering, modified martempering, austempering and ausforming without modification. Additionally, varying sizes of pipe may be accommodated by varying the diameter of the flow chamber inlet.

As will be appreciated by one skilled in the art having the benefit of this disclosure, including the following examples, the present invention results in the production of steel pipes with improved properties not heretofore possible for a given thickness of pipe. Moreover, in some cases the attainable array of properties is greater than previously possible for a given thickness of steel pipe. Additionally, the present invention accomplishes these results at reduced costs through use of the inherent heat of the pipe and smaller quantities of a given cooling medium such as water.

The following examples further illustrate the inventive concept disclosed herein. Naturally, these examples are in no way meant to limit the scope of the present invention, but rather are illustrative only. The examples are based on data taken from the third edition of an Atlas of *Isothermal Transformation Diagrams* published by United States Steel Corporation.

EXAMPLE 1

A modified 1060 grade steel pipe with a carbon content of 0.64%, a manganese content of 1.13% and a silicon content of 0.09% could be austempered by passing it through the flow chamber at a controlled speed such that water flowing through the floating lance and the flow chamber would quench the pipe at an overall rate of approximately 950° F. in 5 seconds to a temperature of approximately 600° F. The blanket of steam would initially hold each quenched portion of the pipe at 600° F. such that the steel would undergo a uniform transformation to bainite. The resulting steel pipe would have a RC hardner number of approximately 52 with a tensile strength of approximately 250,000 psi.

EXAMPLE 2

The process of example 1 could be repeated for a 4068 grade steel pipe with a carbon content of 0.68%, a manganese content of 0.87%, a molybden content of 0.24%, and a silicon content of 0.26%, as well as residual amounts of nickel (0.01%), chromium (0.03%), and copper (0.03%), could be quenched to about 500° F. The blanket of steam would initially hold each quenched portion of the pipe at 500° F. and the resulting steel should have an RC hardness number of 56 and a tensile strength of about 300,000 psi.

Of course, a number of modifications and substitutions may be made in the foregoing apparatus and method without departing from the spirit and scope of the present invention. For example, a portion of the plug 50 may be constructed of an insulating material. Additionally, although water is the preferred quenching medium, it is to be understood that other liquids or solutions can be used to advantage. Futhermore, although the description of the preferred embodiment is restricted to steel pipe, the inventive concept may be employed with other annular or cylindrical shaped pieces of steel. Similarly, the apparatus of the present invention may be employed in conventional isothermal annealing as well as modified martempering, wherein the quench through the martensite region is less severe than in regular martempering, and other heat treating processes.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes and modifications may be made in the size, shape and arrangement of parts. For example, equivalent elements or materials may be substituted for those illustrated and described herein, parts may be reversed, and certain features of the apparatus and process of the invention may be utilized independent of the use of other features, all of which would be apparent to one skilled in the art after having the benefit of this description of the invention. It is intended that the following claims be interpreted to embrace all such modifications and changes as would be apparent to those skilled in the art.

What is claimed is:

1. An apparatus for segmentally cooling successive segments of preheated steel pipe comprising:

(a) a preheater for heating the steel pipe;

(b) a flow chamber configured to receive successive segments of the steel pipe from the preheater and adapted to flow selectively and continuously a cooling medium over the outer surface of the successive segments of the steel pipe;

(c) a plug having a diameter less than the internal diameter of the steel pipe; and (d) an internal feeder having an inlet and an outlet, the outlet being located in the flow chamber and the internal feeder being adapted in conjunction with the plug to flow selectively and continuously a cooling medium over the inner surface of the same successive segments of steel pipe, at least one of said flow chamber and internal feeder being further adapted to control the flow of cooling medium such that the temperature of each segment can be lowered to a desired temperature in the flow chamber and thereafter controlled by using the inherent heat of the segment to vaporize substantially all of the cooling medium to create a vapor blanket along a surface of each segment so cooled to thereby control the temperature of the surface.

2. The apparatus of claim 1 wherein the internal feeder comprises a floating lance which is adapted to remain stationary with respect to the flow chamber.

3. The apparatus of claim 1 or 2 wherein the internal feeder further comprises a detachable cooling medium source.

4. An apparatus for heat treating a steel pipe comprising:

(a) a preheater for heating the steel pipe;

(b) a pipe feeder adapted to feed the steel pipe at a variable rate from the preheater into a flow chamber the flow chamber being less than the length of the pipe and adapted to bring selectively a cooling medium into contact with the outer surface of a segment of the steel pipe after the steel pipe enters the flow chamber;

(c) a plug of sufficient size to seal slidably the inside cross-section of the steel pipe as it passes into the flow chamber, said plug having a contoured surface along the side opposite the preheater; and (d) an internal feeder having a length longer than the flow chamber and having an outside diameter less than that of the steel pipe and adapted to direct a cooling medium against the contoured surface of the plug thereby to bring selectively the cooling medium into contact with the inside surface of a segment of the steel pipe, the plug and the internal feeder being further confined in conjunction with each other to control and direct the flow of cooling medium such that the temperature of each segment of the steel pipe can be lowered to a desired temperature and thereafter controlled by using the inherent heat of the segment to vaporize substantially all the cooling medium to create a vapor blanket along the inside surface of each segment so cooled, the outside diameter and length of the internal feeder being sufficient to maintain the vapor blanket sufficiently to control the temperature of each segment of steel pipe as it passes beyond the flow chamber.

5. An apparatus for heat treating a steel pipe comprising:

(a) a preheater for heating the steel pipe;

(b) a flow chamber having a hollow cylinder with an inside diameter larger than the outside diameter of the pipe, the cylinder having an inlet and an outlet for the pipe and a series of vanes on the inside walls of the cylinder adapted to throw a cooling medium toward the center of the hollow cylinder and onto a steel pipe in the flow chamber, the flow chamber also having a cooling medium inlet adapted to bring the cooling medium in contact with the vanes, and a cooling medium outlet; and the diameter and configuration of the flow chamber being adapted in conjunction with the configuration of the vanes, the flow chamber inlet and outlet and the cooling medium inlet and outlet to control the flow of cooling medium such that each segment of pipe entering the flow chamber is impacted by a sufficient amount of cooling medium to reduce the segment to a desired temperature while vaporizing substantially all of the cooling medium so impacting the segment thereby to form a vapor blanket which is maintained around the segment as it passes through at least a portion of the flow chamber;

(c) a pipe feeder adapted to feed the steel pipe at a predetermined and controllable rate from the preheater and through the pipe inlet and outlet of the flow chamber and thereafter along a predetermined path;

(d) a plug of sufficient size to seal slidably the inside cross-section of the steel pipe as it passes into the flow chamber, said plug having a tapered front portion adapted to receive the steel pipe as it passes from the preheater to the flow chamber pipe inlet and a contoured end portion opposite the tapered end portion; and (e) an internal feeder having an outside diameter less than that of the inside diameter of the steel pipe and extending along the predetermined path of the steel pipe from a point in the flow chamber to a point outside the flow chamber, said internal feeder being adapted to direct a cooling medium against the contoured end portion of the plug thereby to bring selectively the cooling medium into contact with the inside surface of each segment of the steel pipe as it passes through the flow chamber along the predetermined path, and said internal feeder being further adapted in conjunction with the plug and the flow chamber to control and direct the flow of cooling medium such that the temperature of each segment of the steel pipe can be lowered to a desired temperature in the flow chamber by using the inherent heat of the segment to vaporize substantially all the cooling medium flowing through the internal feeder and the inside surface of the pipe and form a vapor blanket along the inside surface of the pipe, the length and diameter of the internal feeder being such in relation to the length and diameter of the steel pipe to maintain at least a portion of the vapor blanket along the inside surface of the pipe segment for a predetermined amount of time as the segment travels beyond the flow chamber, whereby the temperature of each segment of the pipe is controlled as it passes from the flow chamber.

6. The apparatus of claim 5 wherein the internal feeder comprises a rigid conduit with an outside diameter less than that of the steel pipe, the conduit being connected at one end to a detachable cooling medium source and at the other end being sufficiently close to the plug such that the flow of the cooling medium from the internal feeder will impinge upon the contoured surface of the plug with sufficient force to be reversed in direction and flow against the pipe wall.

7. The apparatus of claim 6 wherein the internal feeder further comprises a helical series of vanes attached at their outer periphery to the inside wall of the substantially rigid conduit and attached at their center to a central shaft extending from and integrally mated with the contoured surface of the plugs.

8. The apparatus of claim 5 further comprising a pair of ausforming rolls for deforming the steel pipe as it leaves the flow chamber outlet.

9. The apparatus of claims 4 or 5 further comprising a chamber located downstream of the flow chamber for receiving the steel pipe.

10. The apparatus of claim 9 wherein the chamber is a furnace adapted to maintain the pipe at an elevated temperature.

* * * * *

UNITED STATES PATENT AND TRADEMARK OFFICE

CERTIFICATE OF CORRECTION

PATENT NO. : 4,504,042

DATED : Mar. 12, 1985

INVENTOR(S) : Frederick W. Kruppert

It is certified that error appears in the above-identified patent and that said Letters Patent are hereby corrected as shown below:

Column 17, line 53, delete "confined" and insert therefor --configured--.

Signed and Sealed this

*Thirteenth* Day of *August 1985*

[SEAL]

*Attest:*

DONALD J. QUIGG

*Attesting Officer*

*Acting Commissioner of Patents and Trademarks*